US010304649B2

(12) United States Patent
Udo et al.

(10) Patent No.: US 10,304,649 B2
(45) Date of Patent: May 28, 2019

(54) SWITCH UNIT

(71) Applicant: HONDA MOTOR CO., LTD, Minato-ku, Tokyo (JP)

(72) Inventors: Takeshi Udo, Wako (JP); Masahiko Shimada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/804,820

(22) Filed: Nov. 6, 2017

(65) Prior Publication Data

US 2018/0130628 A1 May 10, 2018

(30) Foreign Application Priority Data

Nov. 9, 2016 (JP) ..... 2016-218779

(51) Int. Cl.

| | |
|---|---|
| ***H01H 19/00*** | (2006.01) |
| ***H01H 89/00*** | (2006.01) |
| ***H01H 19/14*** | (2006.01) |
| ***H01H 23/02*** | (2006.01) |
| ***H01H 23/12*** | (2006.01) |
| *H01H 19/02* | (2006.01) |
| *H01H 23/14* | (2006.01) |
| *H01H 25/00* | (2006.01) |

(52) U.S. Cl.

CPC ..... *H01H 89/00* (2013.01); *H01H 19/003* (2013.01); *H01H 19/14* (2013.01); *H01H 23/025* (2013.01); *H01H 23/12* (2013.01); *H01H 19/025* (2013.01); *H01H 23/143* (2013.01); *H01H 25/00* (2013.01); *H01H 2019/146* (2013.01); *H01H 2219/06* (2013.01); *H01H 2219/062* (2013.01)

(58) Field of Classification Search

CPC ..... H01H 89/00; H01H 19/14; H01H 23/025; H01H 23/12; H01H 2019/146; H01H 23/00; H01H 23/30; H01H 25/00; H01H 25/06; G06F 3/02; G06F 3/023; H04M 1/02; H04M 1/23; H04Q 9/00

USPC ..... 200/314, 341–345, 339, 553, 5 A, 11 R, 200/18, 564, 273, 570, 600

See application file for complete search history.

(56) References Cited

U.S. PATENT DOCUMENTS 7,781,692 B2 * 8/2010 Heerlein ..... H01H 25/008 200/18
2006/0209518 A1 * 9/2006 Nishimoto ..... H01H 19/025 361/760

(Continued)

FOREIGN PATENT DOCUMENTS

JP 63-167616 11/1988
JP 2002-150888 5/2002

(Continued)

OTHER PUBLICATIONS

Japanese Office Action for Japanese Patent Application No. 2016-218779 dated May 15, 2018.

*Primary Examiner* — Ahmed M Saeed
(74) *Attorney, Agent, or Firm* — Amin, Turocy & Watson LLP

(57) ABSTRACT

In a switch unit which is equipped with a seesaw switch and a rotary switch, the seesaw switch and the rotary switch are arranged in a manner so that an axis of a swing fulcrum, i.e., swing shaft, of a knob, and an axis of a rotary shaft of a wheel intersect one another.

4 Claims, 6 Drawing Sheets

(56) References Cited

U.S. PATENT DOCUMENTS

| | | | | |
|---|---|---|---|---|
| 2007/0256912 | A1* | 11/2007 | Shiroyama | H01H 25/065 200/4 |
| 2009/0008233 | A1* | 1/2009 | Saomoto | G05G 5/05 200/6 A |
| 2010/0000846 | A1* | 1/2010 | Nemetz | B25F 5/00 200/336 |

FOREIGN PATENT DOCUMENTS

| | | |
|---|---|---|
| JP | 2004-139256 | 5/2004 |
| JP | 2007-066664 | 3/2007 |

* cited by examiner

PRIOR ART

SWITCH UNIT

CROSS-REFERENCE TO RELATED APPLICATION

This application is based upon and claims the benefit of priority from Japanese Patent Application No. 2016-218779 filed on Nov. 9, 2016, the contents of which are incorporated herein by reference.

BACKGROUND OF THE INVENTION

Field of the Invention:

The present invention relates to a switch unit which, for example, is attached to the steering wheel of a vehicle.

Description of the Related Art:

Conventionally, a switch unit (composite switch) has been known, which is made up from a combination of a rotary switch that rotates a rotating member (wheel) along an outer peripheral surface thereof, and a seesaw switch that allows a swing member (knob) to swing about a support shaft.

For example, as shown in FIGS. 5 and 6, a switch unit 100 disclosed in Japanese Laid-Open Patent Publication No. 2002-150888 is equipped with a rotary switch 104 having a wheel 102, and a seesaw switch 108 having a knob 106. The knob 106 is disposed in surrounding relation to the wheel 102, and is capable of swinging in a circumferential direction of the wheel 102.

In the switch unit 100, the wheel 102 is disposed in an opening 110 provided in the center of the knob 106. A substrate 114 is provided inside a cover 112, and a holder 116 is provided on the substrate 114. A rotary shaft 118 of the wheel 102 is fixed rotatably to the holder 116. Both ends of the rotary shaft 118 are inserted through shaft holes 120 of the knob 106. The knob 106 is supported so as to be capable of swinging with respect to the rotary shaft 118.

An amount of rotation and a direction of rotation of the wheel 102 are detected by a rotary encoder 122. A pressing operation of the wheel 102 in a direction toward the substrate 114 is detected by a tact switch 124 for the rotary switch, which is in contact with the rotary shaft 118. A rocking operation of the knob 106 is detected by tact switches 126 for the seesaw switch, which are provided at a lower end of the knob 106.

Stoppers 128 and plate springs 130 are disposed between the tact switches 126 for the seesaw switch and the lower ends of the knob 106. A rocking motion of the knob 106 is regulated within a predetermined range by the stoppers 128, and after being swung, the knob 106 is capable of returning to its initial position (neutral position) by the plate springs 130.

SUMMARY OF THE INVENTION

Incidentally, in the switch unit 100 of Japanese Laid-Open Patent Publication No. 2002-150888, an axis of the rotary shaft of the wheel 102 of the rotary switch 104 and an axis of a swing shaft of the knob 106 of the seesaw switch 108 are arranged in parallel (coaxially).

For this reason, the knob 106 is arranged along the circumferential direction of the wheel 102, and thus there is a concern that when operating the rotary switch 104, the operator could also mistakenly operate the seesaw switch 108.

The present invention has been devised taking into consideration the aforementioned problem, and has the object of providing a switch unit, which is capable of reliably preventing the occurrence of erroneous operations while efficiently arranging a plurality of switches within a limited space.

A switch unit according to the present invention is equipped with a seesaw switch and a rotary switch, wherein the seesaw switch and the rotary switch are arranged in a manner so that a swing shaft of a seesaw switch operating element, and a rotary shaft of a rotary switch operating element intersect one another.

According to the present invention, the seesaw switch operating element is arranged along an axial direction of the rotary switch operating element. Therefore, it is possible to reliably prevent the occurrence of erroneous operations while efficiently arranging a plurality of switches within a limited space.

Further, preferably, an opening is provided in an operating surface of the seesaw switch operating element, and the rotary switch operating element is arranged in the opening.

In accordance with such a configuration, since the rotary switch operating element and the seesaw switch operating element can be arranged in close proximity to each other, it is possible to enhance the operability of the switch unit as a whole.

Further, preferably, a display unit through which light is capable of passing may be disposed on the operating surface of the seesaw switch operating element, a light source configured to illuminate the display unit may be disposed on a rear surface side of the operating surface, and a gap may be provided between the opening and the rotary switch operating element, wherein light from the light source serves to illuminate the display unit and also illuminate the rotary switch operating element via the gap.

In accordance with such a configuration, it is possible to utilize the light (light leakage) of the light source, which serves to illuminate the seesaw switch operating element, also for illuminating the rotary switch operating element. Therefore, without the need to provide a separate lighting mechanism for the rotary switch operating element inside or outside of the switch unit, nighttime visibility of the rotary switch can be assured. Together with contributing to space conservation, such a feature enhances the freedom in design of the switch unit as a whole.

Further, preferably, the rotary switch operating element is of a cylindrical columnar shape, and reflective surfaces configured to reflect light emitted from the light source are provided at both ends of the rotary switch operating element in the axial direction of the rotary switch operating element.

In accordance with such a configuration, reflection of light which is directed toward the front side of the operating surface is promoted, and nighttime visibility of the rotary switch can further be enhanced.

Further, both ends of the rotary switch operating element in the axial direction thereof may be provided with truncated conical portions, which decrease in diameter toward an outward direction in the axial direction, and the reflective surfaces may be provided on circumferential side surfaces of the truncated conical portions.

In accordance with such a configuration, while avoiding interference with the opening, it is possible to further promote reflection of light that is directed toward the front side of the operating surface.

Furthermore, a light guide member, which is configured to guide light from the light source to the rotary switch operating element and the display unit of the seesaw switch operating element, preferably is provided on a rear side of the operating surface of the seesaw switch operating element.

In accordance with such a configuration, light from the light source can be reliably guided to the rotary switch operating element as well as the display unit of the seesaw switch operating element.

According to the present invention, the seesaw switch operating element is arranged along an axial direction of the rotary switch operating element. Therefore, it is possible to reliably prevent the occurrence of erroneous operations while efficiently arranging a plurality of switches within a limited space.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

A preferred embodiment of a switch unit according to the present invention will be described below with reference to the accompanying drawings.

Figure 1:
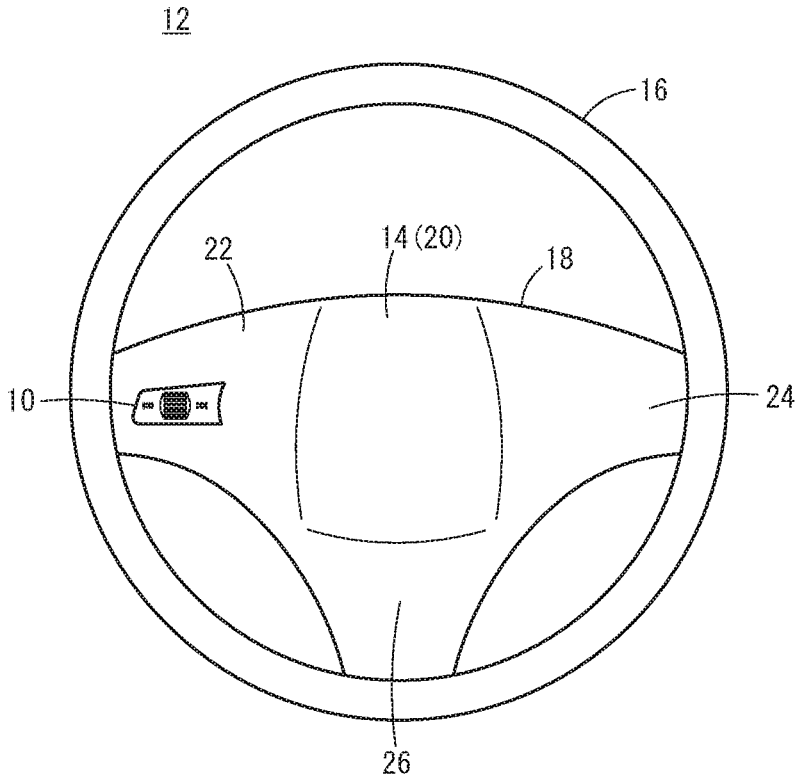
FIG. 1 is a front view of a steering wheel which is equipped with a switch unit according to an embodiment of the present invention.

As shown in FIG. 1, the switch unit 10 according to the present invention is disposed on a steering wheel 12 of a vehicle such as an automobile or the like.

The steering wheel 12 comprises a hub section 14 that is fixed to a non-illustrated steering shaft, an annular rim section 16 to be gripped by the driver, and a substantially T-shaped spoke section 18 connecting the hub section 14 and the rim section 16. An airbag unit (not shown) is installed in the hub section 14, and a horn switch 20 is disposed on an upper surface of the hub section 14.

The spoke section 18 is made up from a left side spoke portion 22 which extends to the left side from the hub section 14, a right side spoke portion 24 which extends to the right side therefrom, and a lower side spoke portion 26 which extends downwardly therefrom, when the steering wheel 12 is in the neutral position as shown in FIG. 1.

A plurality of switches including the switch unit 10 are arranged on the left side spoke portion 22. The plurality of switches are arranged at positions that can be operated with a driver's finger (for example, the thumb) when the rim section 16 is gripped with the left hand in the vicinity of the left side spoke portion 22, and the plurality of switches serve as switches for operating information based vehicle mounted devices such as an audio system, a navigation system, etc. A plurality of switches for operating vehicle mounted devices related to traveling, such as an auto cruise control or the like, are arranged on the right side spoke portion 24. However, these switches are omitted from illustration in FIG. 1.

Figure 2:
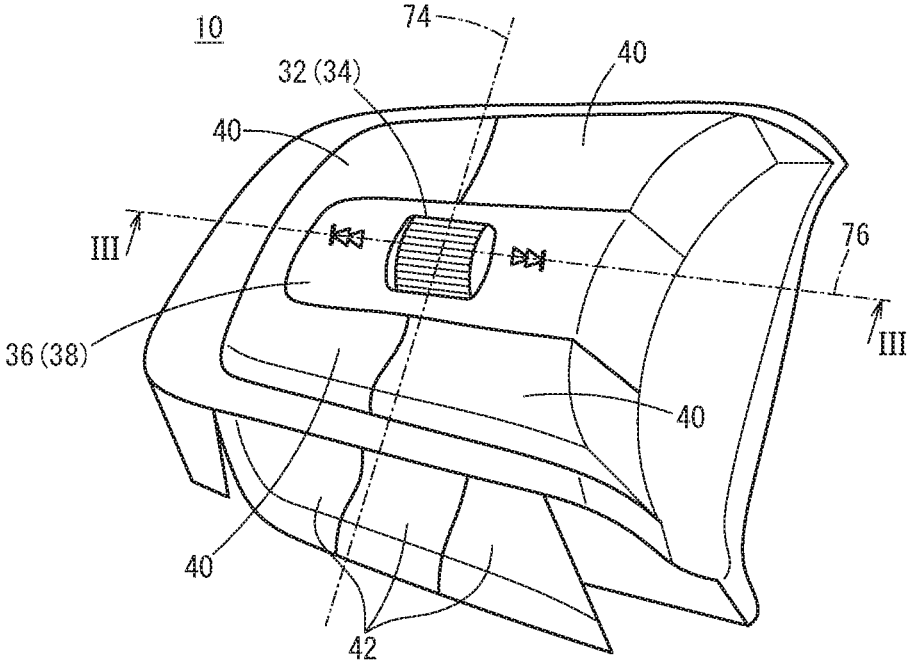
FIG. 2 is an enlarged perspective view showing an exemplary arrangement of a plurality of switches including the switch unit according to the embodiment of the present invention.

FIG. 2 is an enlarged perspective view showing an exemplary arrangement in which a plurality of switches including the switch unit 10 according to the embodiment of the present invention are arranged on the left side spoke portion 22.

As shown in FIG. 2, the switch unit 10 is constituted from a rotary switch 34 having a wheel (rotary switch operating element) 32 which is disposed so as to be capable of rotating by moving a finger in a vertical direction, and a seesaw switch 38 having a knob (seesaw switch operating element) 36, which is disposed so as to be capable of rocking (seesawing) in left and right directions by the finger.

On the outer periphery of the switch unit 10, four push switches 40 are disposed in surrounding relation to the switch unit 10. Furthermore, three separate push switches 42 are disposed in parallel below the push switches 40.

Figure 3:
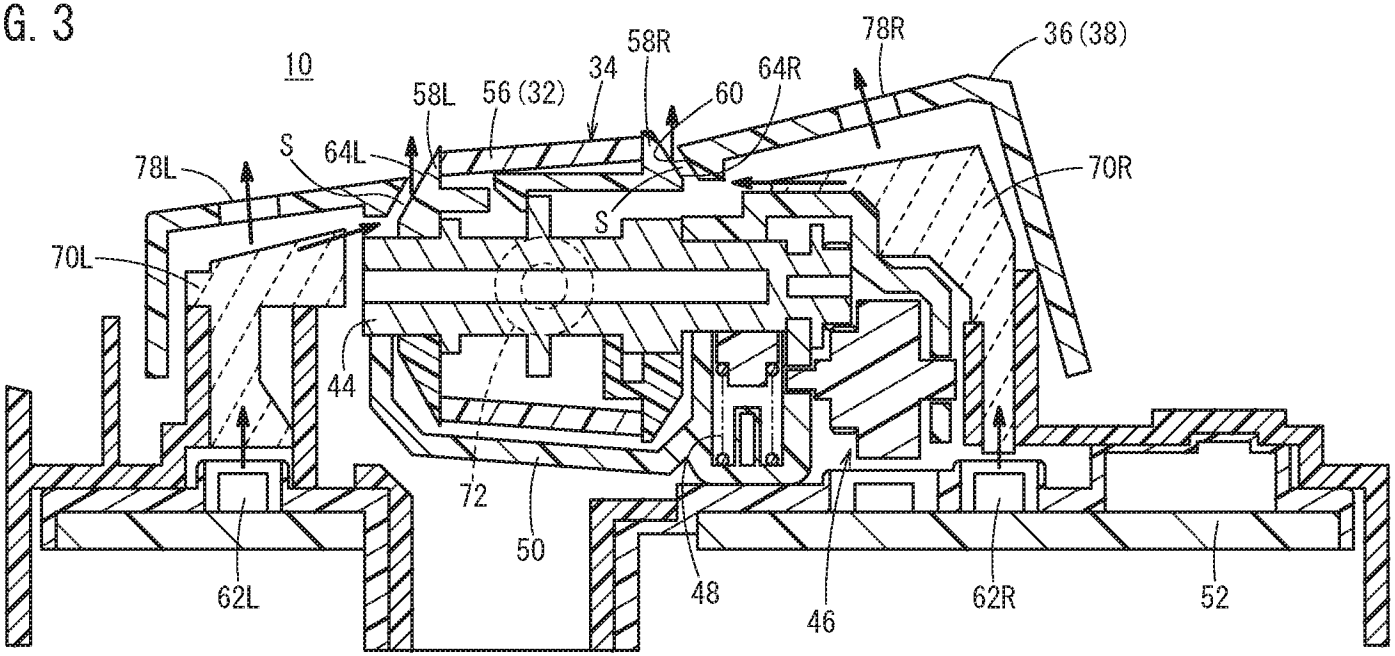
FIG. 3 is a cross-sectional view taken along line III-III of the switch unit shown in FIG. 2.

As shown in FIG. 3, the rotary switch 34 comprises a wheel 32, a rotary shaft 44 attached along an axis of the wheel 32, a rotary encoder 46 adapted to detect an amount of rotation and a direction of rotation of the rotary shaft 44, a spring 48 that biases the wheel 32 in an upward direction, and a casing 50 in which the rotary shaft 44, the rotary encoder 46, and the spring 48 are assembled together in an integral manner. Further, a non-illustrated tact switch for the rotary switch, which outputs a detection signal when the wheel 32 is pressed downward, is disposed on a substrate 52. Such a tact switch for the rotary switch, for example, is disposed on a back side of the wheel 32 in FIG. 3.

The wheel 32 is formed into a substantially cylindrical columnar shape, and is constituted from a substantially cylindrical columnar portion 56 located at the center in the axial direction, and substantially truncated conical portions 58L, 58R, which are disposed at both axial ends of the substantially cylindrical columnar portion 56, and decrease in diameter in an axially outward direction. The upper ends of the substantially cylindrical columnar portion 56 and the substantially truncated conical portions 58L, 58R protrude from an opening 60 provided in the center of the knob 36.

Reflective surfaces 64L, 64R, which reflect light from later-described light sources 62L, 62R externally of the opening 60, are formed on circumferential side surfaces of the substantially truncated conical portions 58L, 58R. The reflective surfaces 64L, 64R are formed by a well-known method such as being coated with silver or the like, for example. Moreover, a fine diffusion pattern for diffusely reflecting (randomly reflecting) light from the light sources 62L, 62R may be formed on the reflective surfaces 64L, 64R. The diffusion pattern is a fine pattern having concave shapes or convex shapes therein, such as for example, a pyramid shape, a hemispherical shape, a triangular prism shape, or the like.

The wheel 32 is disposed so as to be capable of rotating about the axis of the rotary shaft 44, and further to be capable of being pressed toward an inner side of the opening 60 of the knob 36. More specifically, the wheel 32 can be subjected to a rotation operation by moving the finger in a circumferential direction from a lower side toward an upper side, as well as in a circumferential direction from the upper side toward the lower side in FIG. 2, and furthermore, can be subjected to a pressing operation by being pressed with the finger toward the inner side of the opening 60.

According to the present embodiment, for example, a switching function of a replay source of an audio device (FM, AM, CD, hard disk drive, mobile terminal, etc.), a list selecting function in relation to respective content after having decided on the replay source, etc., are assigned with respect to such a rotation operation of the wheel 32.

For example, a menu decision function, an execution function, etc., for the audio equipment are assigned with respect to the pressing operation of the wheel 32. More specifically, the rotary switch 34 is used as a multi-switch in which a plurality of functions such as a feed and return function for options, a decision function, and the like are aggregated.

The seesaw switch 38 comprises the knob 36 which extends in the axial direction of the rotary shaft 44 of the wheel 32, the light sources 62L, 62R which are disposed on the substrate 52 and illuminate the rear surface side of the knob 36, and light guide members 70L, 70R made of transparent resin that guide the light from the light sources 62L, 62R to the wheel 32 and the rear surface side of the knob 36. Further, non-illustrated tact switches for the seesaw switch are provided on the substrate 52, which output detection signals when one end side 66L or another end side 66R of the operating surface 66 of the knob 36 is pressed by the finger and the lower ends of the knob 36 come into contact therewith.

Further, the opening 60, which penetrates through the operating surface 66 in a normal direction to the operating surface 66, is provided in the center of the operating surface 66 of the knob 36. The wheel 32 of the rotary switch 34 is arranged in the opening 60, and a gap S is provided between the wheel 32 and the opening 60. More specifically, the opening 60 has a shape that follows or conforms to the outer shape of the wheel 32.

In the opening 60, end faces thereof which are opposed to the reflective surfaces 64L, 64R of the wheel 32 are tapered corresponding to the angle of inclination of the reflective surfaces 64L, 64R. Light from the light sources 62L, 62R and which has passed through the light guide members 70L, 70R illuminates the wheel 32 via the gap S and is reflected by the reflective surfaces 64L, 64R. Consequently, night visibility of the rotary switch 34 is assured.

Figure 4:
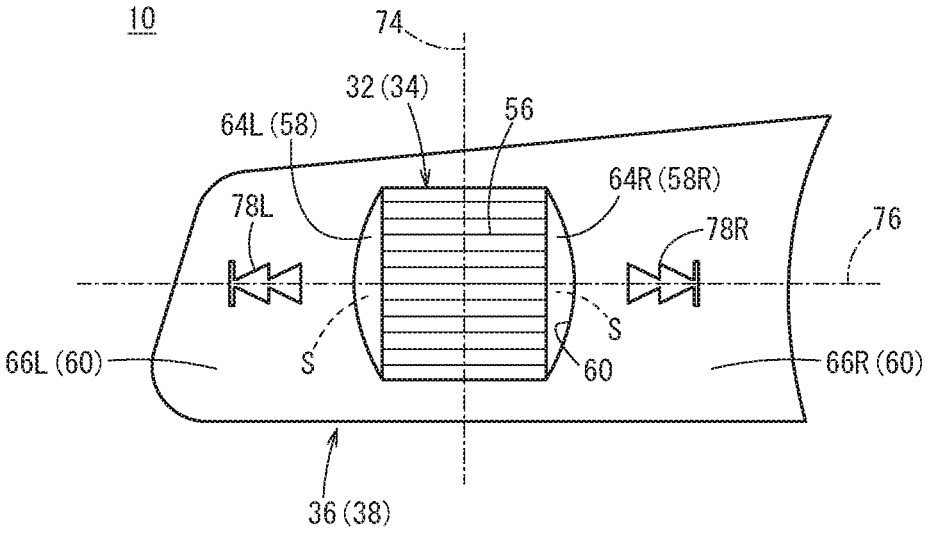
FIG. 4 is a front view of the switch unit shown in FIG. 2.
Figure 5:
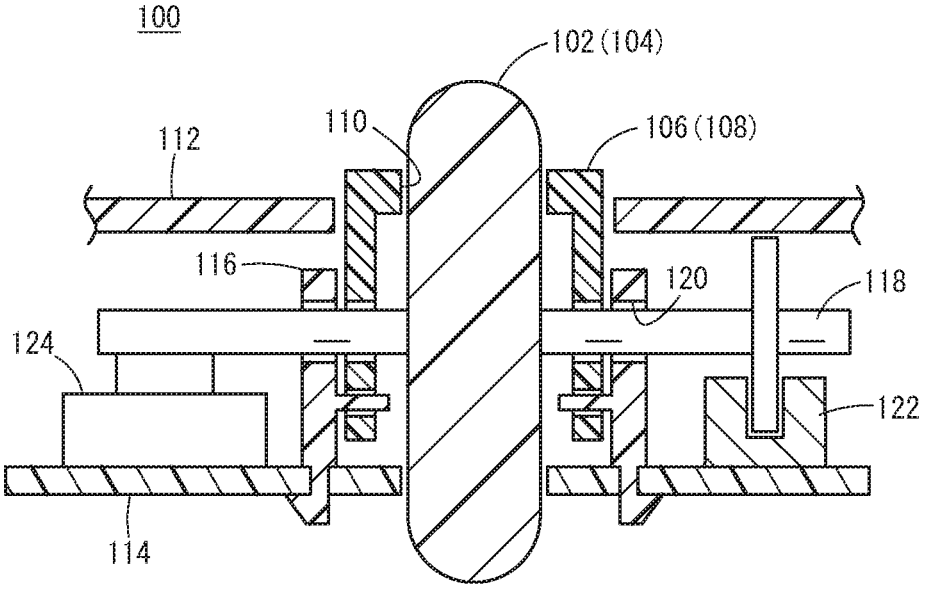
FIG. 5 is a cross-sectional view of a switch unit according to a prior art.
Figure 6:
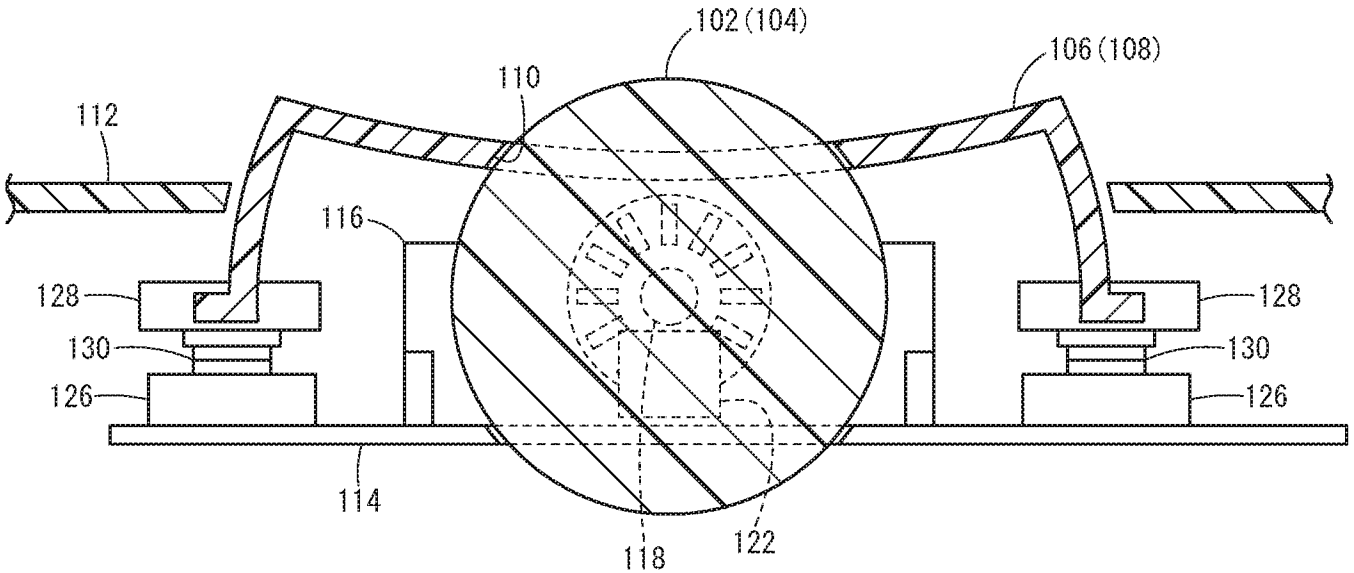
FIG. 6 PRIOR ART
FIG. 6 is a cross-sectional view showing a separate cross-section of the switch unit according to the prior art shown in FIG. 5.

The knob 36 is made up from a light-guiding body such as a transparent resin made of acrylic resin, polycarbonate resin, or the like. On the operating surface 66, an undercoat layer having a white color (or alternatively, a silver color mixed with aluminum powder) is applied, and furthermore, a black light-shielding coating layer is applied over the undercoat layer. In this state, the black light-shielding coating layer is removed by a well-known method such as a laser cutting process, so that the display units 78L, 78R are formed in which letters or figures thereof are outlined or left void. Further, as shown in FIG. 4, the display units 78L, 78R are formed symmetrically with the opening 60 interposed therebetween. As shown in FIG. 3, the display units 78L, 78R are irradiated with light from the light sources 62L, 62R and are illuminated by the light being transmitted therethrough, so that night visibility of the seesaw switch 38 is assured.

As shown in FIG. 3, the knob 36 is disposed in a swingable manner about a swing fulcrum (swing shaft) 72. More specifically, as shown in FIGS. 2 and 4, the seesaw switch 38 and the rotary switch 34 are arranged in a manner so that an axis 74 of the swing fulcrum 72 of the knob 36, and an axis 76 of the rotary shaft 44 of the wheel 32 are arranged orthogonally so as to intersect one another.

When one end side 66L of the operating surface 66 of the knob 36 is pressed downward with a finger, the knob 36 rotates about the swing fulcrum 72, and the other end side 66R is displaced upward. On the other hand, when the other end side 66R of the operating surface 66 of the knob 36 is pressed downward with a finger, the knob 36 rotates about the swing fulcrum 72, and the one end side 66L is displaced upward.

With respect to such a swinging operation of the knob 36, there are assigned, for example, a song fast-forwarding and rewinding function of an audio device, a channel selection function of an AM/FM radio, a folder switching function, and the like. Stated otherwise, the seesaw switch 38 is used, for example, as a dedicated switch responsible for a feed and return function for options, a switching function, and the like.

The light sources 62L, 62R are disposed respectively on the substrate 52 directly below the display units 78L, 78R. Although the light sources 62L, 62R preferably are light emitting diodes (LEDs), for example, they are not particularly limited to this feature. Further, although according to the present embodiment, the light sources 62L, 62R are shown as point light sources, they may be line light sources in which a plurality of point light sources are linearly arranged.

The light guide members 70L, 70R are formed from a light-transmitting resin material or the like. As shown in FIG. 3, the light guide members 70L, 70R are formed respectively with an inverted L-shape in cross-section, and are disposed directly above the light sources 62L, 62R. The light guide members 70L, 70R have end faces as incident surfaces thereof opposed to the light sources 62L, 62R, and guide the light from the light sources 62L, 62R to the display units 78L, 78R of the knob 36, as well as to the reflective surfaces 64L, 64R of the substantially truncated conical portions 58L, 58R of the wheel 32. In order to carry out such illumination more efficiently and brightly, it is preferable that a mirror surface process (coating of a reflective member or the like) be performed on inner wall surfaces of the light guide members 70L, 70R.

As has been described above, in the switch unit 10 according to the embodiment of the present invention, the seesaw switch 38 and the rotary switch 34 are arranged in a manner so that the axis 74 of the swing fulcrum (swing shaft) 72 of the knob (seesaw switch operating element) 36, and the axis 76 of the rotary shaft 44 of the wheel (rotary switch operating element) 32 intersect one another.

Therefore, when the wheel 32 is operated to rotate about the axis of the rotary shaft 44, there is no concern that the operating surface 66 of the knob 36 will be pressed by the operator's finger or the like. More specifically, it is possible to reliably prevent the occurrence of erroneous operations while the seesaw switch 38 and the rotary switch 34 are efficiently disposed within the limited space of the left side spoke portion 22 of the steering wheel 12.

Further, the opening 60, which penetrates in a normal direction to the operating surface 66, is provided in the operating surface 66 of the knob 36, and the wheel 32 is arranged in the opening 60.

In accordance with such a configuration, the knob 36 and the wheel 32 can be arranged in close proximity to each other, and it is possible to enhance the operability of the switch unit 10 as a whole.

Further, the display units 78L, 78R through which light is capable of passing are disposed on the operating surface 66 of the knob 36, the light sources 62L, 62R for illuminating the display units 78L, 78R are disposed on a rear surface side of the operating surface 66, and the gap S is provided between the opening 60 and the wheel 32. The light from the light sources 62L, 62R illuminates the display units 78L, 78R through the light guide members 70L, 70R, together with illuminating the wheel 32 of the rotary switch 34 via the gap S.

In accordance with such a configuration, it is possible to utilize the light sources 62L, 62R, which serve to illuminate the display units 78L, 78R of the seesaw switch 38, also for the purpose of illuminating the wheel 32. Therefore, without the need to provide a separate lighting mechanism for the wheel 32 inside or outside of the switch unit 10, nighttime visibility of the rotary switch 34 can be assured. Together with contributing to space conservation, such a feature enhances the freedom in design of the switch unit 10 as a whole.

Furthermore, the opening 60 is provided in a shape that follows or conforms to the outer shape of the wheel 32.

In accordance with such a configuration, when light from the light sources 62L, 62R illuminates the wheel 32, the operator can reliably recognize and visually perceive the outer shape (contour) of the wheel 32 through the gap S, and thus nighttime visibility of the rotary switch 34 can further be enhanced.

Furthermore, the wheel 32 is of a substantially cylindrical columnar shape, and reflective surfaces 64L, 64R that reflect light emitted from the light sources 62L, 62R are provided at both ends of the wheel 32 in the axial direction of the wheel 32.

In accordance with such a configuration, light reflection, which is directed from the light guide members 70L, 70R toward the front side of the operating surface 66, is promoted, and nighttime visibility of the rotary switch 34 can further be enhanced.

Further, both ends of the wheel 32 in the axial direction of the wheel 32 are provided with the substantially truncated conical portions 58L, 58R, which decrease in diameter toward the outward direction in the axial direction, and the reflective surfaces 64L, 64R are provided on circumferential side surfaces of the substantially truncated conical portions 58L, 58R.

In accordance with such a configuration, while avoiding interference with the opening 60, it is possible to further promote reflection of light that is directed toward the front side of the operating surface 66.

Furthermore, the light guide members 70L, 70R, which guide light from the light sources 62L, 62R to the wheel 32 and the display units 78L, 78R, are provided on the rear side of the operating surface 66 of the knob 36.

In accordance with such a configuration, while realizing saving in space, light from the light sources 62L, 62R can reliably be guided to the wheel 32 as well as the display units 78L, 78R of the knob 36, and thus it is possible to reliably prevent the occurrence of mistaken operations.

Although a description has been presented using an embodiment in which the switch unit 10 is applied to the steering wheel 12 of a vehicle, the arrangement and placement of the switch unit according to the present invention is not limited thereby.

The present invention is not limited to the above-described embodiment, and it is a matter of course that various configurations could be adopted therein without deviating from the essence and gist of the present invention.

What is claimed is:

1. A switch unit equipped with a seesaw switch and a rotary switch, wherein the seesaw switch and the rotary switch are arranged in a manner so that a swing shaft of a seesaw switch operating element and a rotary shaft of a rotary switch operating element intersect one another, wherein an opening is provided in an operating surface of the seesaw switch operating element, the rotary switch operating element is arranged in the opening, a display unit through which light is capable of passing is disposed on the operating surface of the seesaw switch operating element, a light source configured to illuminate the display unit is disposed on a rear surface side of the operating surface, a gap is provided between the opening and the rotary switch operating element, light from the light source illuminates the display unit and also illuminates the rotary switch operating element via the gap, the rotary switch operating element is of a cylindrical columnar shape, and reflective surfaces configured to reflect light emitted from the light source are provided at both ends of the rotary switch operating element in an axial direction of the rotary switch operating element.

2. The switch unit according to claim 1, wherein:

both ends of the rotary switch operating element in the axial direction of the rotary switch operating element are provided with truncated conical portions which decrease in diameter toward an outward direction in the axial direction, and the reflective surfaces are provided on circumferential side surfaces of the truncated conical portions.

3. The switch unit according to claim 1, wherein a light guide member, which is configured to guide light from the light source to the rotary switch operating element and the display unit of the seesaw switch operating element, is provided on a rear side of the operating surface of the seesaw operating element.

4. The switch unit according to claim 2, wherein a light guide member, which is configured to guide light from the light source to the rotary switch operating element and the display unit of the seesaw switch operating element, is provided on a rear side of the operating surface of the seesaw operating element.

* * * * *